United States Patent [19]

Wien

[11] 4,316,620

[45] Feb. 23, 1982

[54] DEVICES ADAPTED FOR USE ON SKI POLES

[76] Inventor: Arve Wien, Fabrikkveien 5, NO-2380 Brumunddad, Norway

[21] Appl. No.: 30,707

[22] Filed: Apr. 16, 1979

[30] Foreign Application Priority Data

Apr. 13, 1978 [NO] Norway ..... 781292

[51] Int. Cl.[3] ..... A63C 11/24

[52] U.S. Cl. ..... 280/824

[58] Field of Search ..... 280/11.37 N, 11.37 Z, 280/11.37 P, 819, 824

[56] References Cited

FOREIGN PATENT DOCUMENTS 2282920 3/1976 France ..... 280/824

74506 1/1949 Norway ..... 280/824

193652 1/1938 Switzerland ..... 280/824

436072 11/1967 Switzerland ..... 280/824

444736 2/1968 Switzerland ..... 280/824

*Primary Examiner*—Joseph F. Peters, Jr.

*Assistant Examiner*—Michael Mar

[57] ABSTRACT

Device for use on ski poles having a permanent ski ring. The device includes an annular plate which provides a support surface of substantially larger dimension in the radial plane of the ski pole than a conventional ski ring. The plate is capable of being arranged on the ring to increase its supporting ability in loose snow. The annular plate incorporates a fastener adapted for releasable engagement with the ski ring.

1 Claim, 5 Drawing Figures

DEVICES ADAPTED FOR USE ON SKI POLES

BACKGROUND OF THE INVENTION

1. Field of the Invention

This invention relates to devices adapted for use on ski poles having a permanent ski ring, so as to increase supporting ability in loose snow.

2. Description of the Prior Art

In skiing under varying run and snow conditions, dissimilar requirements are placed on the size of the ski ring. Generally, the rings are made as light as possible, especially with poles used for competition which are now also normally utilised by long distance skiers. Such light rings are, however, too small to provide sufficient supporting ability in loose snow, especially in the case of unprepared ski runs.

What is needed is a device which can be releasably fastened to conventional ski poles, that is to say ski poles having relatively small rings.

SUMMARY OF THE INVENTION

Accordingly the present invention resides in a device adapted for use on ski poles having a permanent ski ring and which comprises means for forming a support surface of substantially larger dimension in the radial plane of the ski pole than a conventional ski ring and capable of being arranged on said ring to increase its supporting ability in loose snow, said support surface-forming means including fastening means adapted for releasable engagement with said ski ring.

Such a device can be readily positioned on an ordinary ski ring and readily removed therefrom if conditions dictate that use of an expanded ring is unnecessary.

In addition, such an arrangement, with minor adaptations, can be utilised as a reserve ring if the normal ring is broken or destroyed in another way.

BRIEF DESCRIPTION OF THE DRAWINGS

In order that the invention can be more clearly understood, convenient embodiments thereof will now be described, by way of example, with reference to the accompanying drawings in which.

DESCRIPTION OF THE CONVENIENT EMBODIMENTS

Figure 1:
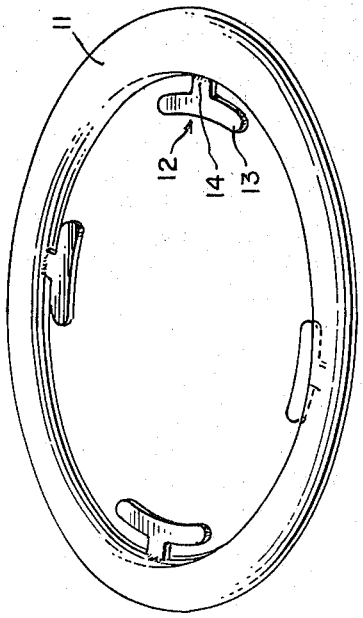
FIG. 1 is a perspective view of a device of a first embodiment.

Referring to FIG. 1, a circular ring 11 has an inverted arcuate profile in vertical cross-section, that is to say the opening is directed downwards. This ring has an appearance like a turned over annular mould portion for a conical cake. At the inner edge of the ring, there are four fastening lugs 12 arranged at uniform mutual distances. These fastening lugs 12 are appropriately formed from the same material as the ring 11 and are integral therewith, the material being a synthetic plastics material or a light metal. The fastening lugs 12 include wings 13 which extend to both sides from a central connection 14 to the ring 11. These fastening lugs 12 can serve to anchor the device of this embodiment to a ski ring (not shown) by means of cords, strings, straps or similar fastening means. The ring 11 is preferably dimensioned so that during use it will be located a distance outside the ski ring.

The device of this embodiment can by manufacture from a synthetic plastics material be modified so that the fastening lugs 12 can be brought into releasable engagement with corresponding portions of the ski ring so that the connection which is formed can absorb forces up and down the longitudinal direction of the ski pole. The fastening lugs 12 can be made of an elastically flexible synthetic plastics material and can be dimensioned so as to be able to absorb the forces which the device is able to transfer.

Figure 2:
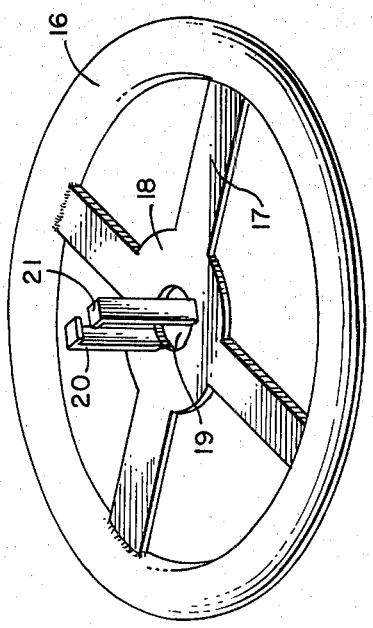
FIG. 2 is a perspective view of a device of a second embodiment.

In FIG. 2, there is shown a second embodiment in which a ring 16, which, in vertical cross-section, has an inverted arcuate profile similar to that of the ring 11 of the embodiment of FIG. 1, is connected by means of four spokes 17 to a hub 18 having a pierced opening 19 for the tip (not shown) of a ski pole. The spokes 17 are preferably of planar form so that they can contribute to increase the supporting ability of the ski pole and, in addition, form abutments against the ring.

At the edge of the opening 19, there are arranged two axially extending, opposing catch studs 20 which are provided at their respective ends with a lug 21 projecting radially inwards. The two lugs 21 will thus be directed towards each other. By the suitable choice of material, the studs 20 can be made elastic so that the lugs 21 can be bent to the side and guided past the tip of the ski pole and into engagement with corresponding portions of the ring. The studs 20 are appropriately provided with gripping edges (not shown) so that they can be easily bent to the side when the device is to be guided into position or drawn off the ski pole.

Figure 3:
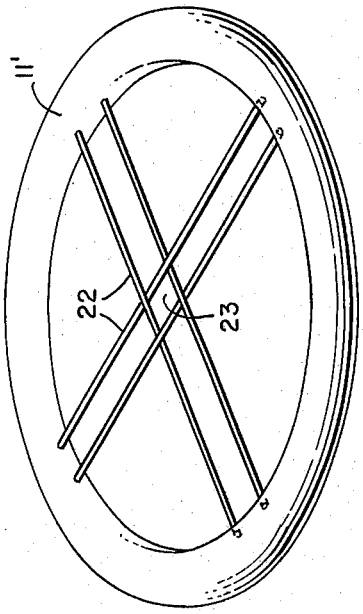
FIG. 3 is a perspective view of a device of a third embodiment.

In FIG. 3, there is shown a third embodiment which resembles the embodiment of FIG. 1. Thus it comprises a ring 11' but the fastening lugs 12 of the embodiment of FIG. 1 are replaced by two pairs of cords 22 which extend as a cross across the opening of the ring 11' so that in the center they define a quadratic opening 23. The cords 22 can suitably be of nylon since they can be readily moulded into ring 11' of synthetic plastics material. The device of this embodiment can be readily threaded over a ski pole tip at the opening 23.

Figure 4:
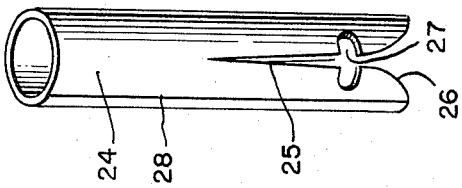
FIG. 4 is a perspective view of a fastening sleeve designed to be used together with the embodiment of FIG. 3.

In FIG. 4, there is shown an example of a sleeve 24 which can be used to hold the device of FIG. 3 securely to the ski ring. The sleeve 24 is produced in the form of a pipe from synthetic plastics material, if desired with a longitudinal slit 28 for simplifying the application of the sleeve 24 over the hand grip of the ski pole. From the end of the sleeve 24, which is designed to be guided towards the ring, there are taken out two opposing notches 25 having sloping entrance edges 26 at the outer end. A distance in from the end, the notches 25 are provided with extensions 27 at both sides. The object of these extensions is to provide space for central portions of the ski ring and the cords 22 so that these are locked to each other and held securely in position. Preferably, the extensions 27 ought to be made so deep and designed with such sharp edges that it is not possible to draw off the device shown in FIG. 3 without spreading the notches by manual force.

Figure 5:
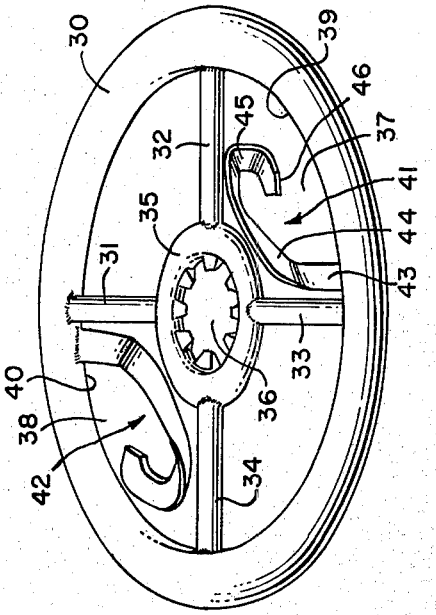
FIG. 5 is a perspective view of a device of a fourth embodiment.

In the embodiment of FIG. 5, a circular ring 30 has a form, in vertical cross-section, of an inverted arcuate profile and generally resembles that of the embodiment of FIG. 2. Four spokes 31,32,33,34 are connected to a hub 35 having an opening 36 for receiving the tip (not shown) of the ski pole and defined by symmetrically spaced teeth extending radially inwards from the inner circular surface of the hub. The spokes can be generally triangular in vertical cross-section.

Occupying two opposite quadrants 37,38 of the ring as defined by inner side portions 39,40 of the latter, the spokes 32,33;31,34 and portions of the hub 35, are flexible catch claws 41,42. Each claw 41,42 has a plane portion 43 extending radially inwards towards the hub 35 from a position of the ring adjacent spoke 33,31 before merging into an upright portion 44 which itself merges into a recessed hook-shaped portion 45 having a pointed end 46 turned back towards, but spaced from, the juncture between the upright and hook-shaped portions 44,45.

The device of the embodiment of FIG. 5 can conveniently be moulded from a synthetic plastics material.

The embodiments of the invention as illustrated have in common that they are easy and reasonable to manufacture and also convenient to take on a skiing trip. Besides, with simple manual engagement, they can be brought into position on the ski pole and in corresponding fashion they can be readily removed when they are no longer needed. They can be easily dimensioned so that they give sufficient supporting ability to the ski pole even in very loose snow.

In addition, should the ski ring loosen or be destroyed, they can be utilised with simple means as reserve rings.

I claim:

1. A device adapted for use on ski poles having a permanent ski ring to provide an auxiliary support for said ring and which comprises annular plate means for forming a support surface of substantially larger dimension in the radial plane of the ski pole than said ski ring and capable of being arranged on said ring to increase its supporting ability in loose snow, said annular plate means surrounding at its inner side a circular space and comprising a central hub, four radial spokes joining said inner side to said hub and defining therebetween four similar space quadrants, said hub being formed with an opening for receiving said ski pole defined by symmetrically spaced teeth extending radially inwards from the inner circular surface thereof, and a pair of catch claws occupying opposite space quadrants and adapted for ready manual attachment to and release from said ski ring.

* * * * *